US011408298B2

(12) United States Patent
Pardo

(10) Patent No.: US 11,408,298 B2
(45) Date of Patent: Aug. 9, 2022

(54) SEALING OF A TURBINE

(71) Applicant: SAFRAN HELICOPTER ENGINES, Bordes (FR)

(72) Inventor: Frédéric Philippe Jean-Jacques Pardo, Moissy-Cramayel (FR)

(73) Assignee: SAFRAN HELICOPTER ENGINES, Bordes (FR)

( * ) Notice: Subject to any disclaimer, the term of this patent is extended or adjusted under 35 U.S.C. 154(b) by 0 days.

(21) Appl. No.: 17/277,873

(22) PCT Filed: Sep. 20, 2019

(86) PCT No.: PCT/FR2019/052206

§ 371 (c)(1),
(2) Date: Mar. 19, 2021

(87) PCT Pub. No.: WO2020/058648

PCT Pub. Date: Mar. 26, 2020

(65) Prior Publication Data

US 2021/0348518 A1 Nov. 11, 2021

(30) Foreign Application Priority Data

Sep. 20, 2018 (FR) ..... 1858527

(51) Int. Cl.
*F01D 11/00* (2006.01)
*F01D 9/04* (2006.01)

(52) U.S. Cl.
CPC ..... *F01D 11/005* (2013.01); *F01D 9/041* (2013.01); *F05D 2240/55* (2013.01); *F05D 2250/283* (2013.01)

(58) Field of Classification Search
CPC ..... F01D 9/04; F01D 9/041; F01D 11/003; F01D 11/005; F01D 25/24; F01D 25/246;
(Continued)

(56) References Cited

U.S. PATENT DOCUMENTS 9,797,515 B2 * 10/2017 Kloepfer ..... F01D 25/246
10,655,490 B2 5/2020 Boeck
(Continued)

FOREIGN PATENT DOCUMENTS

EP 2469043 A2 6/2012
EP 3363994 A1 8/2018

OTHER PUBLICATIONS

International Search Report dated Jan. 21, 2020, issued in corresponding International Application No. PCT/FR2019/052206, filed Sep. 20, 2019, 5 pages.
(Continued)

*Primary Examiner* — Eldon T Brockman
*Assistant Examiner* — Danielle M. Christensen
(74) *Attorney, Agent, or Firm* — Christensen O'Connor Johnson Kindness PLLC

(57) ABSTRACT

An assembly for a multistage turbine of a turbomachine has a static sealing device and a nozzle with a radially outer end and an outer casing surrounding the nozzle. The static sealing device is arranged radially between a radially outer end of the nozzle and the outer casing. The static sealing device includes an annular seal borne by the nozzle and an annular structure that defines a plurality of radial annular walls. The walls are axially spaced apart from one another, and at least one first wall is in annular contact radially inwardly with the annular seal. A longitudinal dimension of the annular contact is less than a longitudinal dimension of the seal.

12 Claims, 2 Drawing Sheets

(58) Field of Classification Search
CPC ..... F05D 2240/10; F05D 2240/11; F05D 2240/128; F05D 2240/55; F05D 2250/283
See application file for complete search history.

(56) References Cited

U.S. PATENT DOCUMENTS

| | | | | |
|---|---|---|---|---|
| 2004/0219014 | A1 | 11/2004 | Synnott | |
| 2011/0182722 | A1* | 7/2011 | Matsuyama | F01D 11/005 415/174.2 |
| 2019/0270155 | A1* | 9/2019 | Arnould | F01D 11/127 |

OTHER PUBLICATIONS

Written Opinion dated Jan. 21, 2020, issued in corresponding International Application No. PCT/FR2019/052206, filed Sep. 20, 2019, 5 pages.
Written Opinion dated Jan. 21, 2020, issued in corresponding International Application No. PCT/FR2019/052206, filed Sep. 20, 2019, 4 pages.
International Preliminary Report on Patentability dated Mar. 23, 2021, issued in corresponding International Application No. PCT/FR2019/052206, filed Sep. 20, 2019, 6 pages.

* cited by examiner

SEALING OF A TURBINE

FIELD OF THE INVENTION

The present invention concerns the general field of devices providing a sealing function in a turbine stage in a turbomachine, such as an aircraft turbojet or turboprop engine.

BACKGROUND OF THE INVENTION

Classically, as shown in FIG. 1, a turbine 10 comprises a plurality of stages 12 each formed by an annular row of stationary blades 14 externally supported by an outer casing 16 and an annular row of moving blades 18. A radially outer annular platform 20 is mounted at the radially outer end of the fixed blades 14. Each annular row of fixed blades forms a nozzle 22. The moving blades 18 comprise a radially outer annular platform 24 with rubbing strips 26 intended to cooperate with a ring 28 of abradable material. The terms 'radially inward' or 'radially outward' are to be understood in relation to a radial direction with respect to the axis of rotation of the bladed wheel 18 which is the axis of rotation of the rotor of the turbine 10.

During operation, it is necessary to limit the leakage of hot air out of the flow path, i.e. the hot air flows radially outwards at an annular gap between the downstream end of the outer annular platform of an upstream bladed turbine US, and the upstream end of the platform of a nozzle, arranged downstream DS. This hot air leakage reduces the performance of the turbomachine and can also lead to heating of the casing and all surrounding parts in general.

A first technical solution would be to place a seal between an outer turbine casing and the radially outer platform of the nozzle. The integration of the seal allows to limit the flow of hot air out of the flow path. However, the integration of the seal can cause heat conduction problems between the nozzleand the outer casing of the turbine. This thermal problem is due to the difficulty of achieving perfect contact between three separate parts, namely the nozzle, the seal and the outer turbine casing. This optimal contact between the three parts limits hot air leakage, but implies a significant thermal conduction between the nozzleand the outer casing, which mechanically weakens the latter.

Thus, as shown in FIG. 1, a technology has been proposed to address the technological problems mentioned above. technological problems mentioned above.

The radially outer platform 20 of the nozzle 22 has an upstream end extending substantially longitudinally in the direction of the radially outer platform 24 of the bladed wheel 18 with moving blades. The downstream end of the radially outer platform 20 comprises a radial flange 30 extending radially outwards.

The radially outer platform 20 also comprises a shoulder 32 on its radially outer side.

An additional annular part 34 is attached to the radially outer platform 20 at the shoulder 32. Thus, the additional annular part 34 has a base 36. The radially inner surface of the base 36 is in radial contact with the radially outer face of the platform 20 and the longitudinally downstream surface of base 36 is in longitudinal contact with the shoulder 32 of the radially outer platform 20. From a radially outer end of the base 36 of the additional annular part 34 extend first and second annular walls 38, 40.

The first annular wall 38 extends from the radially outer upstream end of base 36 and the second annular wall 40 extends from the radially outer downstream end of the base 36. The first and second annular walls 38, 40 comprise respectively a first part 38*a*, 40*a* and a second part 38*b*, 40*b*.

The first annular wall 38 comprises a first part 38*a* which extends with a radial outward component and a longitudinal upstream component and the second part 38*b* which extends only with a longitudinal upstream component.

The second annular wall 40 comprises a first part 40*a* which extends with a radial outward component and a longitudinal downstream component and the second part 40*b* extends only with a longitudinal downstream component.

The downstream end of the second annular wall comes longitudinally close, without contact, or in abutment with the radial flange 30 of the radially outer platform 20 of the nozzle 22.

The outer casing 16 has an annular groove 42 opening radially inwards, opposite to the nozzle 22, i.e. the additional annular part 34 attached to the nozzle 22. A annual seal 44 positioned in the annular groove 42. The seal 44 has an upstream end in contact with an upstream radial wall delimiting the annular groove 42 upstream. The annular seal 44 also has a downstream end in contact with a downstream wall delimiting the annular groove 42 downstream.

The annular groove 42 of the outer casing 16 also has a bottom. However, seal 44 has no radial contact with the bottom of the annular groove 42.

A portion of the seal 44 inserted in annular groove 42 projects radially inward from the radially inner ends of the upstream and downstream walls delimiting the annular groove 42. The radially inner end of the seal portion 44 protruding from the annular groove 42 radially abuts the radially outer surface of the second annular wall part 40*b* of the second annular wall 40 of the additional annular part 34, so as to form an annular surface contact.

During operation, a portion of the hot air flows out of the stream between the downstream end of the radially outer platform 24 of an upstream bladed turbine 18 and an upstream end of the radially outer platform of a nozzle 22 arranged downstream of the bladed turbine 18. The displacement of this hot air out of the flow path is limited by the presence of a baffle plate 46 formed by the first annular wall 38 of the additional annular part 34. This baffle plate 46 allows part of the air intended to be directed downstream of the first annular wall 38 of the additional annular part 34 to be diverted into the non-flow path part.

In addition, the air which has nevertheless flowed out of the flow path downstream of the first annular wall 38 of the additional annular part 34 is blocked by means of the seal 44 arranged radially between the outer casing 16 and the second annular wall 40 of the additional annular part 34.

Finally, the use of an additional annular part 34 limits the heat conduction from the nozzle 22 to the outer casing 16 of the turbine 10, so that the temperature of the outer casing 16 is acceptable.

Nevertheless, if the gain in thermal conduction is significant, it proves to be limited and requires the use of an additional annular part 34 whose mass is not negligible. This additional mass increases the consumption of the turbomachine.

In addition, the shape of this additional ring piece 34 is complex and expensive to produce. Furthermore, the integration of this annular part 34 does not ensure a good contact surface between the annular seal 44 and the second annular wall 40 of said annular part 34.

Finally, this additional ring part 34 requires an expensive assembly solution (welding, brazing, use of pins, . . . ).

The invention aims at realizing a sealing device making it possible to limit the thermal conduction between the nozzle 22 and the outer casing 16 of the turbine while overcoming the problems mentioned above and this at a lower cost.

SUMMARY OF THE INVENTION

The present invention relates to an assembly for a multistage turbine of a turbomachine, the assembly comprising a static sealing device, a turbine nozzle comprising a radially outer end and an outer casing surrounding the nozzle, the static sealing device being arranged radially between a radially outer end of the nozzle and the outer casing, and comprising an annular seal borne by the nozzle and an annular structure defining a plurality of radial annular walls axially spaced apart from one another, at least one first wall of said radial annular walls being in annular contact radially inwardly with the annular seal and its longitudinal dimension being less than the longitudinal dimension of the seal.

At least one of the radial annular walls of the annular structure has a smaller longitudinal dimension than that of the seal at the contact area between the seal and said radial annular wall, thereby reducing the contact area between the seal and the annular structure. When this contact area is reduced, it is easier to ensure a correct level of sealing between the nozzle and the outer casing via the annular seal.

If the contact surface is large, leakage paths can occur between the annular seal and an annular structure of the outer casing. These leaks can be caused by a flatness defect in the contact surface of the annular seal. The presence of leakage paths alters the sealing between the nozzle and the outer casing of the turbine and reduces the heat conduction between these parts. However, in this invention, the reduction of the contact area improves control and limits the possibility of leakage paths. The sealing is thus improved if the contact area between the seal and one of the radial walls of the annular structure is reduced.

The annular seal can be in annular linear contact with said at least one first radial annular wall of the annular structure.

Since the contact area between the annular seal and the radially inner end of the radial annular wall is to be reduced, it is then preferable that this contact be linear.

The annular structure can have a hollow shape shaped so as to comprise at least two radial annular walls whose spacing in the longitudinal direction is less than the longitudinal dimension of the seal.

Advantageously, the fact that the spacing in the longitudinal direction of two adjacent radial annular walls of the annular structure is smaller than the longitudinal dimension of the seal ensures that the annular seal is in contact over the entire circumference with at least one of the radial annular walls of the annular structure. In this way, irrespective of the shape and longitudinal dimension between an upstream end and a downstream end of the radial annular wall in contact with the seal, the seal annularly contacts the radially inner end of the radial annular wall of the annular structure without discontinuity.

The nozzle can comprise a radial annular part with an annular opening radially outwards and receiving said annular seal.

The seal is housed in an annular groove which comprises an upstream and a downstream annular flank. During operation, the air flow in the turbine induces an overpressure on an upstream surface of the seal. The seal is then compressed axially at its downstream surface against the downstream annular flank of the annular groove. In this state of axial compression, the seal abuts the downstream annular flank of the annular groove.

During operation, the effects of pressure keep the seal in contact with the downstream flank of the groove.

The radially outer end of the nozzle in contact with the annular seal preferably has a groove opening radially outwards, more precisely opposite the annular structure, to receive the seal. This groove prevents the seal from moving in a longitudinal direction. In this way, the annular contact between the seal and the radially inner end of at least one radial annular wall is ensured.

In one embodiment, the nozzle comprises a radial annular part, in the thickness of which the groove is formed.

The annular seal can comprise at least two rings, in particular two rings, arranged longitudinally in abutment against each other.

Preferably, the rings are cracked. The slot in these split rings is sized to form a leak at the split portion of the ring as small as possible when the turbine is in operation. Slotted rings have a radially inward elastic compression or a radially outward elastic expansion, depending on the desired cylindrical span. If a seal comprising two split rings is used, the rings are mounted at an angle so that the slots are spaced apart from each other to avoid even partial overlapping of the slots which would allow hot air to escape. Preferably, the slots are positioned diametrically opposite each other.

Preferably, each of the rings can be in annular contact with at least one radial annular wall of the annular structure.

The fact that the seal has at least two structurally independent rings arranged longitudinally in abutment allows each of these rings to be in contact with at least one radially inner end of at least one radial annular wall respectively.

The annular structure can have a plurality of cavities, opening radially inwards formed at least in part by the radial annular walls of the annular structure.

The presence of cavities opening radially inwards from the annular structure allows, by increasing the number of spaced surfaces, to further limit the heat transfer from the nozzle to the outer casing of the turbine.

The static parts of a turbine have axial and radial movements relative to each other. As a result, the seal can move axially while ensuring radial contact with at least one of the radial annular walls of the annular structure. The annular structure with radial annular walls forming cavities is more abradable than conventional devices and the seal will fit perfectly with the opposite radial annular wall.

Each of the cavities can be hexagonal in shape.

In a first embodiment, the longitudinal dimension of the seal is greater than or equal to half the longitudinal dimension of a cavity.

In a first method of construction, the longitudinal dimension of the seal is greater than or equal to half the longitudinal dimension of a cell.

In the case where the longitudinal dimension of the seal is greater than or equal to the dimension of a half cell, and more particularly less than the dimension of a cavity, precise positioning of the groove receiving the seal and of the radial annular walls of the annular structure makes it possible to ensure an annular contact without discontinuity between the annular seal and the radially inner end of one of the radial annular walls.

In a second embodiment, the longitudinal dimension of the seal is greater than or equal to the longitudinal dimension of a cavity.

In this case, precise positioning of the groove receiving the seal and of the radial annular walls of the annular structure is not necessary to ensure the annular contact of the seal with at least one of the radial annular walls partially defining a plurality of cavities.

Advantageously, if the longitudinal dimension of the ring seal is greater than or equal to the longitudinal dimension of a cavity, the entire lower ends of the walls defining the cell are in annular contact with the seal.

In a third embodiment, the longitudinal dimension of each of the rings of the seal is greater than or equal to half the longitudinal dimension of a cavity. Precise positioning of the groove receiving the seal and of the radial annular walls of the annular structure is necessary so that at least one of the two rings of the seal and at least one of the radial annular walls are in annular contact.

In a fourth embodiment, the longitudinal dimension of each of the rings of the seal is greater than or equal to the longitudinal dimension of a cavity. In this case, precise positioning of the groove receiving the seal and of the radial annular walls of the annular structure is not necessarily required to ensure annular contact of the seal with at least one of the radial annular walls partially defining a plurality of cavities.

Preferably, the annular structure can be formed of several structurally independent sectors arranged circumferentially end to end.

The sectorization of the annular structure allows simple and easy mounting in a groove of the outer casing, opening radially inwards.

Preferably, the annular contact between the annular seal or a ring and the radially inner end of one of the radial annular walls is linear.

The invention will be better understood and other details, characteristics and advantages of the invention will appear when reading the following description, which is given as a non-limiting example, with reference to the attached drawings.

DETAILED DESCRIPTION

Figure 1:
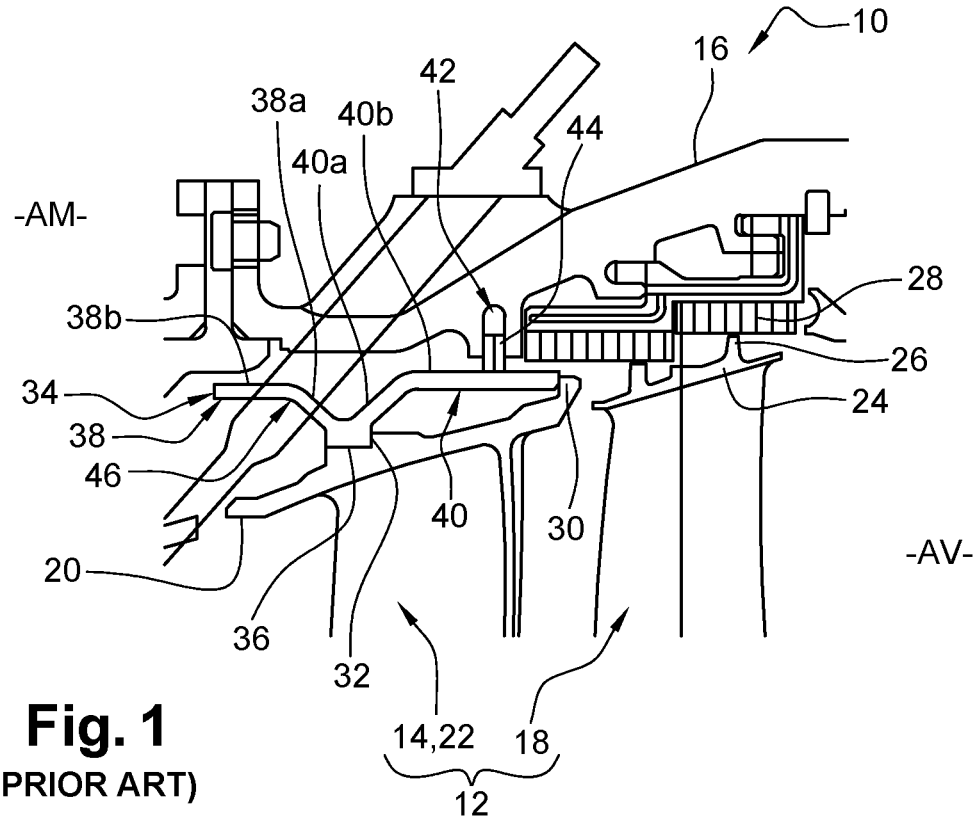
Fig. 1 (PRIOR ART)
FIG. 1 shows a partial sectional view of a turbomachine turbine according to the prior art.

FIG. 1, showing a sealing device according to the prior art arranged inside a turbomachine turbine 10, was described earlier.

Figure 2:
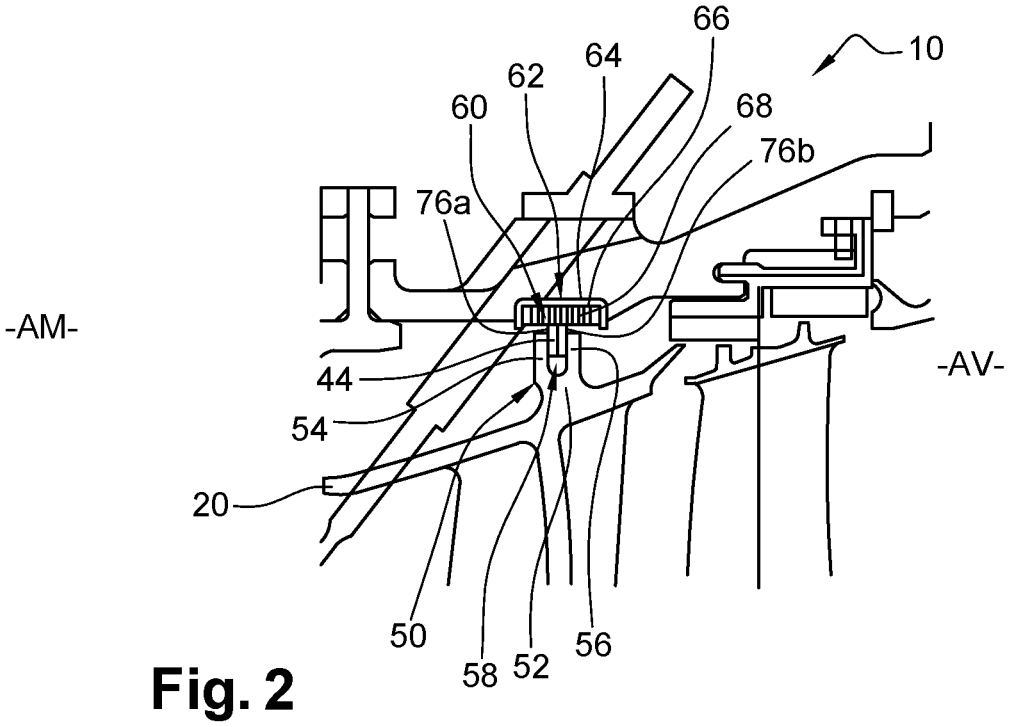
FIG. 2 shows a sectional view of a turbomachine turbine according to the invention.

FIG. 2 shows a turbine comprising a sealing device according to the invention.

The nozzle 22 has a radially outer platform 20 at its radially outer end. From the radially outer platform 20, an annular projection 50 extends radially outwards. The annular projection 50 includes a connecting area 52 and radial upstream and downstream annular walls 54, 56. As shown in FIG. 2, the upstream and downstream annular walls 54, 56 are parallel to each other and extend radially outwards from the connecting area 52.

The upstream and downstream radial annular walls 54, 56 and the connecting area 52 of the projection 50 form an annular groove 58. The upstream and downstream radial annular walls 54, 56 define flanks of the annular groove while the connecting area 50 defines a bottom of the groove 58. The annular groove 58 receives the annular seal 44. The annular seal 44 is arranged in the groove so that a portion of it protrudes radially from the radially outer ends of the upstream and downstream radial annular walls 54, 56 defining the groove 58.

The annular seal 44 has an upstream longitudinal surface abutting the upstream radial annular wall 54 of the groove 58 and a downstream longitudinal surface abutting the downstream radial annular wall 56 of the groove 58. These longitudinal stops of the seal 44 allow the annular seal 44 to be held in position without having to be radially in abutment with the bottom of the groove 58.

The radially outer end of the projecting annular seal 44 radially abuts a radially inner surface of an annular structure 60 attached to the outer casing 16 of the turbine 10.

The outer casing 16 has an annular groove 62 with a bottom 64 and two flanks opening radially. The groove 62 opens radially inwards opposite to the groove 58 of the nozzle 22. The groove 62 of the outer casing 16 receives the annular structure 60 which is attached to the bottom wall 64 of the groove 62 by means of an annular cylinder 66.

The attachment of the annular structure 60 to the bottom wall 64 of the groove 62 formed on the outer casing 16 can be carried out by brazing.

The annular structure 60 thus has an annular cylindrical wall 66, from which a plurality of radial annular walls 68 extend. The radial annular walls 68 of the annular structure 60 are longitudinally spaced from each other.

In another embodiment, the radial annular walls 68 of the annular structure 60 could be directly formed by laser fusion on the bottom wall 64 of the groove 62.

The radially outer end of the seal 44 is radially in abutment with a radially inner end of at least one of the radial annular walls 68 of the annular structure 60. The contact between the seal 44 and a radial annular wall 68 of annular structure 60 is annular and continuous.

Figure 3A:
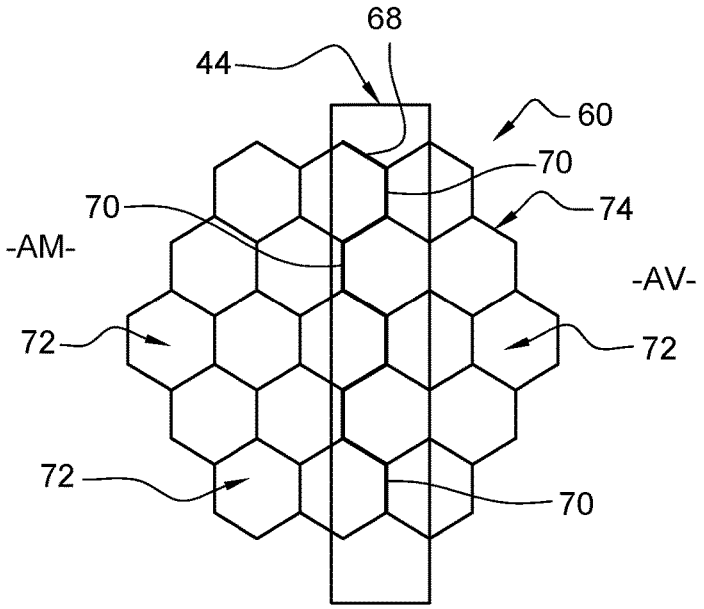
FIG. 3A is a sectional view of the contact area between the seal and the annular structure.
Figure 4A:
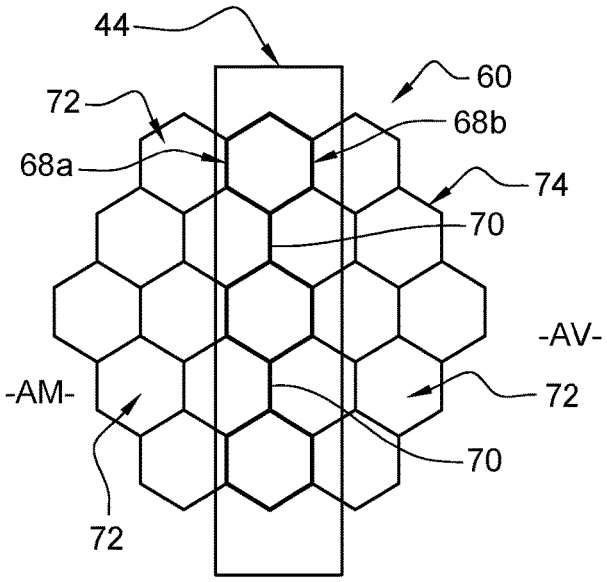
FIG. 4A is a sectional view of the contact area between the seal and the annular structure.
Figure 4B:
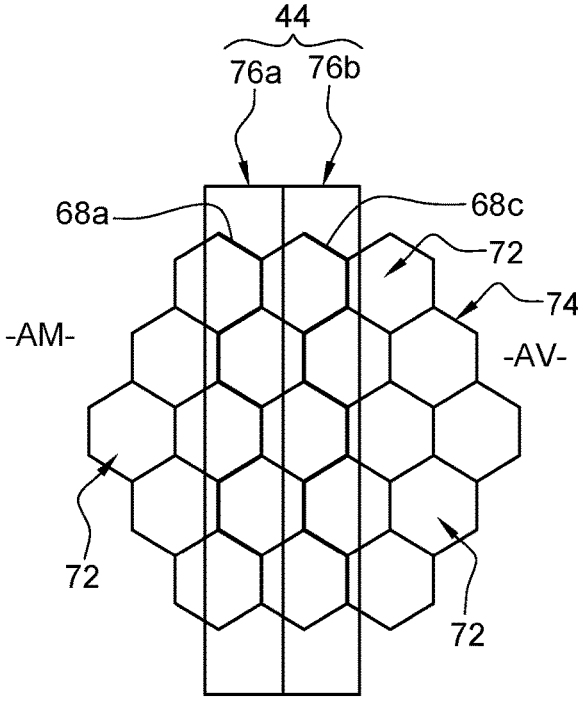
FIG. 4B is a sectional view at the contact area between the rings forming the seal and the annular structure.

In one embodiment, illustrated in FIGS. 3A, 4A and 4B, the radial annular walls 68 have common wall sections 70. The common wall sections 70 are circumferentially spaced from each other.

The radial annular walls 68 with common sections 58 form cavities 72. The annular structure 60 thus has a honeycomb structure 74 formed by the plurality of radial annular walls 68.

The plurality of cavities 72 has a hexagonal structure.

In a different design, the 72 cavities could be triangular, square, rectangular or octagonal in shape.

Figure 3B:
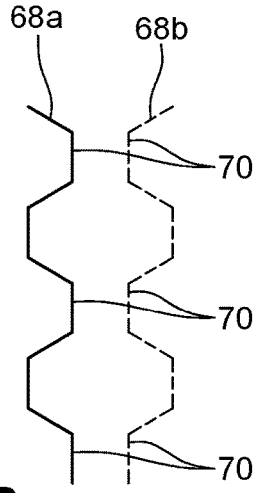
FIG. 3B is a sectional view of two radial annular walls intended to be brazed together.

FIG. 3B shows two longitudinally adjacent radial annular walls 68*a*, 68*b* of the annular structure 60 obtained by stamping a sheet metal. These longitudinally adjacent radial annular walls 68*a*, 68*b* have wall portions intended to be welded or brazed together at the common sections 70.

In an alternative embodiment, the radial annular walls 68 of the annular structure 60 are obtained by additive manufacturing.

As shown in FIG. 3A, the annular seal 44 is arranged annularly in contact with the radially inner end of a radial annular wall 68. The longitudinal dimension of the annular seal 44 shall be sufficient to come into radial contact at the upstream and downstream ends of the radial annular wall 68 with which it is in contact.

In an alternative embodiment, the spacing in a longitudinal direction between two longitudinally adjacent radial annular walls 68*a*, 68*b* is less than the longitudinal dimension of the annular seal 44. In this way, the annular seal 44 makes annular contact with the radially inner ends of the two longitudinally adjacent walls 68*a*, 68*b*.

If the annular structure 60 has a honeycomb structure 74, the longitudinal dimension of the ring joint 44 shall be at least half the longitudinal dimension of a cavity 72. In this way, by precise positioning of the radial annular walls 68 of the annular structure 60 and of the groove 58 receiving the annular seal 44, annular contact of the seal with at least one of said radial annular walls 68 is ensured.

If the longitudinal dimension of the annular seal 44 is greater than the longitudinal dimension of a recess 72, then precise positioning of the radial annular walls 68 of the annular structure 60 and of the groove 58 receiving the annular seal 44 is not necessary to ensure annular contact between the annular seal and at least one of the radially inner ends of the radial annular walls 68 of the annular structure 60.

In particular, as shown in FIG. 4A, if the longitudinal dimension of the annular seal 44 is greater than the longitudinal dimension of the cavities 72, then the annular seal 44 can make annular radial contact with the radially inner ends of two adjacent radial annular walls 68*a*, 68*b*.

In one embodiment, illustrated in FIGS. 2 and 4B, the annular seal 44 has two rings 76*a*, 76*b* longitudinally abutting each other. These rings are preferentially split. The first ring 76*a* has an upstream end in longitudinal abutment with the upstream annular wall 54 of the annular groove 58 of nozzle 22 and a downstream end in longitudinal abutment with the upstream end of the second ring 76*b*. The downstream end of the second ring 76*b* is in longitudinal abutment with the downstream radial annular wall 56 of groove 58 of nozzle 22.

Where the annular seal 44 has two rings 76*a*, 76*b* arranged longitudinally in abutment, it is advantageous that each of them has annular radial contact with one of the radial annular walls 68 of the annular structure 60.

The radial annular walls 68*a*, 68*c* in contact with the rings 76*a*, 76*b* forming the annular seal 44 are not necessarily longitudinally adjacent, as shown in FIG. 4B.

As described above, a ring 76*a*, 76*b* can have a longitudinal dimension greater than the longitudinal spacing between two longitudinally adjacent radial annular walls 68*a*, 68*b*.

In particular, a ring 76*a*, 76*b* can have a longitudinal dimension greater than or equal to half the longitudinal dimension of a cavity 72 or the longitudinal dimension of a cavity 72.

Preferably, the annular seal 44 or each ring 76*a*, 76*b* is annularly in contact with the radially inner end of a radial annular wall 68 of annular structure 60.

Advantageously, the contact between the annular seal 44 or one of the rings 76*a*, 76*b* forming part of an annular seal 44 and a radial annular wall 68 is linear, so as to allow the contact area between them to be reduced.

The reduced contact surface makes it easier to check the contact surface of the annular seal 44 and to limit the presence of leakage paths. Thus, the sealing between the nozzle 22 and the outer casing 16 of the turbine 10 is ensured.

In addition, the reduced contact surface reduces the heat conduction between the nozzle 22 and the outer casing 16 efficiently.

Finally, the absence of discontinuity in the contact between the annular seal 44 and at least one of the radial annular walls 68 of the annular structure 60 prevents the reduction in the performance of turbine 10 and reduces the heating of the outer casing 16 and the surrounding parts.

The said annular structure 60 is preferably composed of a plurality of structurally independent sectors arranged circumferentially in abutment. This sectorization of the annular structure 60 allows it to be arranged in the annular groove 62 of the outer casing 16 and to be fixed to the outer casing 16.

The invention claimed is:

1. An assembly for a multistage turbine of a turbomachine, the assembly comprising a static sealing device, a nozzle comprising a radially outer end and an outer casing surrounding the nozzle, the static sealing device being arranged radially between said radially outer end of the nozzle and the outer casing, and comprising an annular seal borne by the nozzle and an annular structure defining a plurality of radial annular walls axially spaced apart from one another, at least one first wall of said radial annular walls being in annular contact radially inwardly with the annular seal and having a longitudinal dimension that is less than a longitudinal dimension of the annular seal.

2. The assembly according to claim 1, wherein the annular seal is in annular linear contact with said at least one first radial annular wall of the annular structure.

3. The assembly according to claim 1, wherein the annular structure has a hollow shape comprising at least two radial annular walls of the plurality of radial annular walls, wherein spacing of the at least two radial annular walls in a longitudinal direction is less than the longitudinal dimension of the seal.

4. The assembly according to claim 1, wherein the nozzle comprises a radial annular portion having an annular groove opening radially outwards and receiving said annular seal.

5. The assembly according to claim 1, wherein the annular seal comprises at least two rings.

6. The assembly according to claim 5, wherein each of the at least two rings is in annular linear contact with at least one radial annular wall of the annual structure.

7. The assembly according to claim 1, wherein the annular structure has a plurality of cavities opening radially inwards formed at least in part by the radial annular walls of the annular structure.

8. The assembly according to claim 7, wherein each of the plurality of cavities has a hexagonal shape.

9. The assembly according to claim 7, wherein the longitudinal dimension of the seal is greater than or equal to half the longitudinal dimension of one of the plurality of cavities.

10. The assembly according to claim 7, wherein the longitudinal dimension of the seal is greater than or equal to the longitudinal dimension of one of the plurality of cavities.

11. The assembly according to claim 1, wherein the annular structure is formed of several structurally independent sectors arranged circumferentially end to end.

12. The assembly according to claim 1, wherein the annular seal comprises two rings arranged longitudinally in abutment against each other.

* * * * *